US005425384A

United States Patent [19]

White

[11] Patent Number: 5,425,384

[45] Date of Patent: Jun. 20, 1995

[54] ROTARY TOBACCO TREATMENT CYLINDERS

[75] Inventor: Victor A. White, Finmere, England

[73] Assignee: GBE International PLC, Andover, Great Britain

[21] Appl. No.: 849,372

[22] PCT Filed: Nov. 2, 1990

[86] PCT No.: PCT/GB90/01688

§ 371 Date: Jun. 12, 1992

§ 102(e) Date: Jun. 12, 1992

[87] PCT Pub. No.: WO91/06228

PCT Pub. Date: May 16, 1991

[30] Foreign Application Priority Data

Nov. 3, 1989 [GB] United Kingdom ..... 8923885.0

[51] Int. Cl.[6] ..... A24B 3/04

[52] U.S. Cl. ..... 131/305; 131/290

[58] Field of Search ..... 131/305, 300, 301, 302, 131/304, 290; 34/108, 132, 133 D; 366/22, 54, 56

[56] References Cited

U.S. PATENT DOCUMENTS 1,595,659 8/1926 How .
4,592,150 6/1986 Schnupp .
4,984,587 1/1991 Neville ..... 131/305

FOREIGN PATENT DOCUMENTS 538851 6/1955 Belgium .
902023 7/1985 Belgium .
338099 10/1989 European Pat. Off. .
451617 4/1913 France .
2039203 1/1972 Germany ..... 131/305
264922 2/1927 United Kingdom .
942727 11/1963 United Kingdom .

*Primary Examiner*—Jennifer Bahr
*Attorney, Agent, or Firm*—Dowell & Dowell

[57] ABSTRACT

A rotary tobacco treatment cylinder includes an elongate hollow cylinder arranged to rotate about its longitudinal axis and disposed substantially horizontally or inclined by a small angle to the horizontal, a series of elongate paddles extending longitudinally within the cylinder and extending generally towards the longitudinal axis from the inside surface of the cylinder, the paddles serving to convey material to be treated from a lower position within the conveyor and around one side to an upper discharge position. Each of the paddies has a proximal portion extending at a first angle being a right angle to the tangent at the root of the proximal portion or an angle less than a right angle at the loaded side of the paddle, and a distal portion which is inclined to the proximal portion at a second angle, which is less than the first angle, to form a tip. A major part of the tip considered longitudinally is of a length (viewed axially of the cylinder) less than half the length of the proximal portion. The angle of the tip of each paddle to the tangent at the root of the proximal portion is such that at a predetermined release point the tip is at the angle of sliding, the surface of the tobacco charge just contained by the top being at the angle of repose.

18 Claims, 6 Drawing Sheets (PRIOR ART)

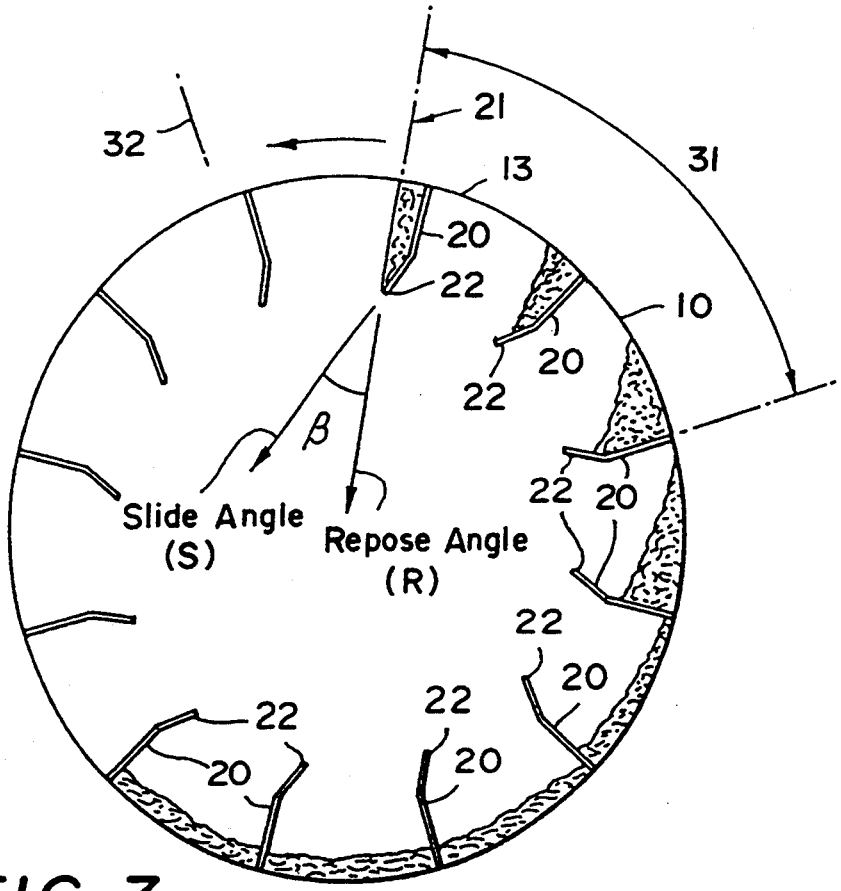
FIG. 3
FIG. 4
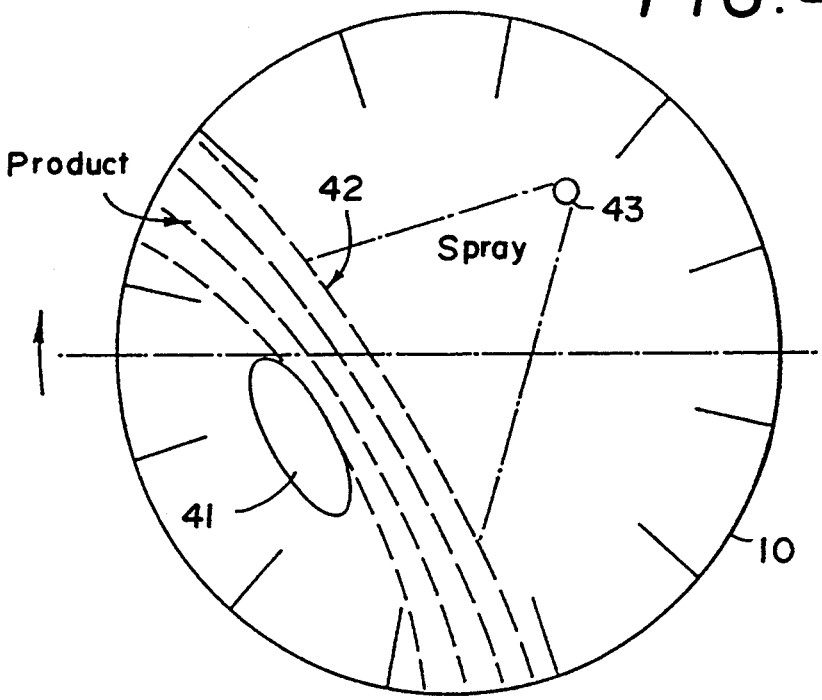
(PRIOR ART)

ROTARY TOBACCO TREATMENT CYLINDERS

BACKGROUND OF THE INVENTION

This invention relates to improvements in rotary tobacco treatment cylinders and is particularly concerned with the geometry of internal paddles or flights in such cylinders, which are provided to optimize the treatment of tobacco in the cylinder.

In the pre-treatment of tobacco before manufacture within cigarettes, it is necessary to subject it to drying, mixing processes, or conditioning with the addition of fluid; and these are often carried out in a rotary treatment cylinder which is arranged to rotate about a generally horizontal or slightly inclined axis. Such treatment cylinders are provided with internal paddles to provide transport of the tobacco product through the cylinder. In the cases of drying and conditioning it is necessary to maintain the transport time through the cylinder; not only should the average time of the mass of tobacco be maintained but also the time for each individual particle.

Furthermore, the tumbling of tobacco within such a cylinder tends to cause degradation. This degradation is very dependent upon moisture content and increases rapidly with reduction of moisture content below normal cigarette moisture contents of some 13–14%. Thus variation in moisture content in the output from a drying cylinder can be a major contribution to tobacco degradation.

There are several factors which can affect the transport time such as paddle loading, cylinder inclination, drop height, that is to say the height within the cylinder from which the material drops from a paddle to fall back to the wall of the cylinder during the tumbling operation, and the number of drops. However a factor which has been generally overlooked is the consistency which is determined by the release point and which is particularly important in the case of drying.

SUMMARY OF THE INVENTION

It is an object of the present invention to provide an arrangement in which the release position can be precisely predetermined.

A further object of the invention is to provide a consistent rapid release of the tobacco from the paddle i.e. a sharply defined release point, instead of a slow sliding or tumbling off action.

According to the present invention there is provided a rotary tobacco treatment cylinder comprising an elongate hollow cylinder arranged to rotate about its longitudinal axis and disposed substantially horizontally or inclined by a small angle to the horizontal, a series of elongate paddles extending longitudinally within the cylinder and extending generally towards the longitudinal axis from the inside surface of the cylinder, the paddles serving to convey material to be treated from a lower position within the conveyor and around one side to an upper discharge position, the paddles having a proximal portion extending at a first angle being a right angle to the tangent at the root of the proximal portion or an angle less than a right angle at the loaded side of the paddle, and a distal portion which is inclined to the proximal portion at a second angle, which is less than the first angle, to form a tip, a major part of the tip considered longitudinally being of a length (viewed axially of the cylinder) less than half the length of the proximal portion, characterised in that the cross-sectional area of the material to be treated which is loaded onto a paddle, is less than or equal to the area enclosed by the paddle and a line from the paddle tip to the cylinder wall at the angle of repose of the material to be treated, when the paddle in question is at a predetermined release point around the cylinder.

Further according to the invention the angle of the tip of each paddle to the tangent at the root of the proximal portion is such that at a predetermined release point the tip is at the angle of sliding, the surface of the tobacco charge just contained by the tip being at the angle of repose.

Preferably the proximal portion of the paddle is radially disposed.

Another aspect of the invention is that the tip is inclined relative to the proximal portion at an angle substantially greater than the difference between the angle of repose and the angle of sliding, the paddles being suitable for light loading.

Yet another aspect of the invention is that the tip is inclined relative to the proximal portion at an angle substantially equal to the difference between the angle of repose and the angle of sliding, the angle of repose being parallel to the proximal portion of the paddle.

Further according to the invention the tip is inclined relative to the proximal portion at an angle substantially less than the difference between the angle of repose and the angle of sliding, the paddles being suitable for heavy loading.

Preferably, for a drying application, the arrangement of such paddles is such that as the cylinder rotates, material carried by the paddles leaves the paddles at substantially the same release point around the arc of the cylinder disposed substantially at the highest part of the cylinder.

For the application of a fluid treatment, the arrangement of paddles is such that as the cylinder rotates the tobacco carried by the paddles leaves the paddles from a chosen initial early release point at one end gradually changing to a late release point at the other end of the cylinder such as to cause the material to be treated to fall from the paddles in a curtain extending obliquely of the cylinder axis, at an acute angle to the axis of the cylinder.

Preferably the arrangement of the paddles is such as to cause the formation of a second such curtain following the first curtain axially along the cylinder.

BRIEF DESCRIPTION OF THE DRAWINGS

The present invention will now be described, by way of example with references to the accompanying drawings in which:

FIG. 3 is a similar cross section to FIG. 2 of an embodiment of the invention, FIG. 4 shows a schematic cross-section of a typical known cylinder used for fluid application.

DETAILED DESCRIPTION OF THE PREFERRED EMBODIMENT

Figure 1:
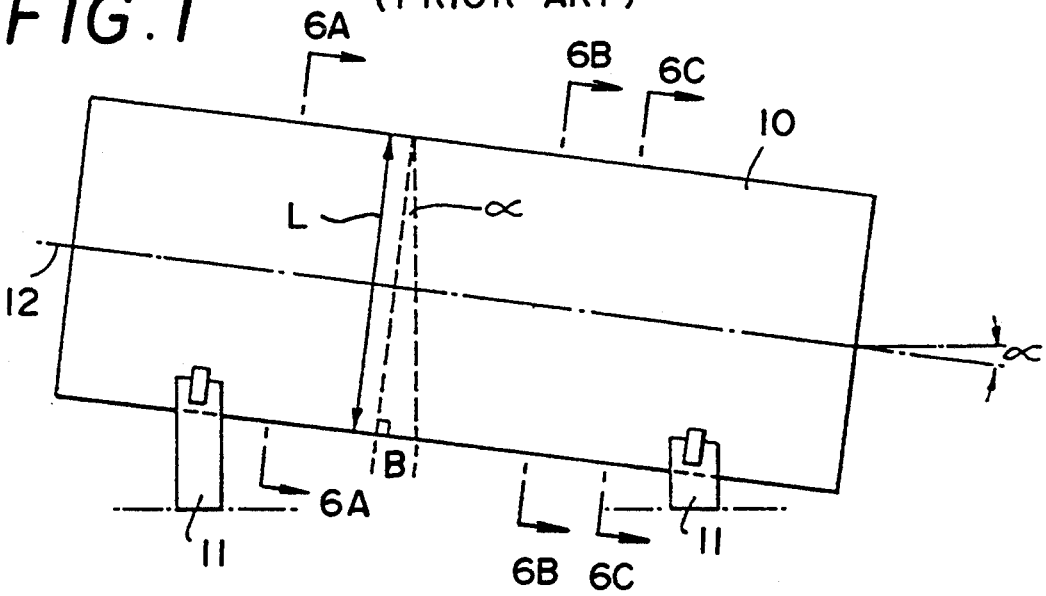
FIG. 1 (PRIOR ART)
FIG. 1 is a schematic side elevation of a typical treatment cylinder to which the invention relates.
Figure 2:
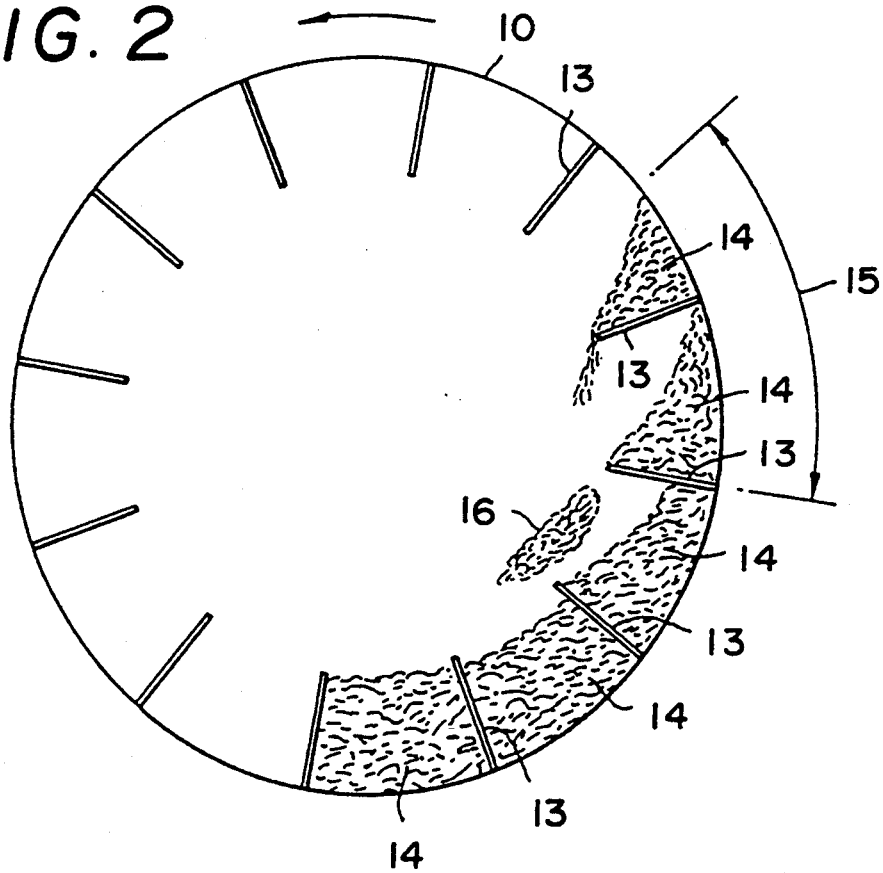
FIG. 2 is a schematic view of a typical cross section of the cylinder of FIG. 1.

FIGS. 1 and 2 show a typical treatment cylinder 10 arranged on supports 11 to rotate about an axis 12 which is inclined at an angle a to the horizontal. The cylinder is, as shown in FIG. 2, fitted with a series of elongate internal paddles 13 extending longitudinally within the cylinder, which paddles assist, in conventional manner, in the tumbling action of the tobacco passing from an inlet at the upper end of the cylinder to an outlet at the lower end of the cylinder.

In FIG. 1 there is shown schematically a height L from which any particular paddle may drop tobacco carried from the bottom of the cylinder, back to the bottom of the cylinder thus, taking account of the angle $\alpha$, advancing the material an approximate distance B along the cylinder. Thus it can be seen that for a consistent transit time of tobacco through the cylinder it is desirable that each increment B is identical and controlled and thus the release height L should also be controlled.

In FIG. 2 tobacco material is shown schematically on the wall of the cylinder between the paddles 13 as indicated at 14. It can be seen that as the cylinder rotates the surface of the material 14 presented to the interior of the cylinder will assume the angle of repose (R) for the material within each pocket formed between the paddles. In this specification the angle of repose (R) is interpreted to refer to the angle of the edge surface that the material will freely assume in a heap, relative to a horizontal plane. Eventually as a particular parcel of tobacco material progresses with the cylinder on the paddle 13, there will come a time when the paddle 13 is at the angle of sliding (S) relative to the horizontal which in this specification is intended to refer to that angle of the paddle to the horizontal at which the tobacco material will slide off it irrespective of the angle of repose. Thus it can be seen that with the conventional radial paddles as shown in FIG. 2 the tobacco material will effect a sliding movement across the edge of the paddle tip as the paddle surface exceeds the angle of repose (R) and will eventually slide off the paddle as the angle of the paddle (P) exceeds the angle of sliding (S). With conventional cylinders with radial paddles, this takes place over an arc indicated at 15 which is often indeterminate and invariably at a low elevation relative to the axis of the cylinder.

For tobacco products the angle of repose (R) is typically between 60 and 90 degrees and is for one exemplary type of cut tobacco material approximately 85 degrees. For such cut tobacco products the angle of sliding (S) is typically between 30 and 60 degrees to the horizontal on a typical metal surface paddle.

It can be seen that with the prior arrangement of FIG. 2, firstly the tobacco material has contact with only a small area of the wall of the cylinder and of the paddles and thus has little opportunity to take up heat from those items when they are heated in a drying process. Secondly the material has a short path to fall back to the bottom since it barely reaches a point above the horizontal before it slides or falls off the paddles, thus in the drying process can have little opportunity to give up its moisture to the interior of the cylinder. Thirdly because the material leaves the paddles over an arc, the residence time and the fall or drop distance are variable. This again results in variation in the treatment of any particular portion of the tobacco.

Again in some instances, particularly when the pockets between the paddles are over filled, because the tobacco falls back to the bottom in the extreme right hand corner of the cylinder as viewed in FIG. 2, in some circumstances it can become formed into a roll-like filament in an area indicated generally at 16 in FIG. 2. This again results in a poor treatment of the material in that area, which may be likened to the situation with no paddles, often referred to as kilning.

FIG. 3 shows an embodiment of the invention which alleviates these problems. Each paddle 13 comprises a proximal portion 20 extending at a first angle being a right angle to the tangent at the root of the proximal portion or an angle less than a right angle at the loaded side of the paddle, and a distal portion 22, which is inclined to the proximal portion at a second angle, which is less than the first angle, to form a tip. The tip is of a length, viewed axially of the cylinder, not exceeding half the length of the proximal portion. Preferably, the tip is one third the length of the portion 20.

In this embodiment the paddle tips 22 are inclined to a radius passing through the tip at a paddle angle indicated generally at $\beta$. The angle $\beta$ is chosen to be approximately equal to the difference between the angle of repose (R) for the material being treated and the sliding angle (S) for that material as defined above.

With this arrangement which is particularly suitable for drying and conditioning as discussed below, it can be seen that the material is lifted by the paddles to be released only at a much higher point round the arc of the cylinder as indicated at 21 and that no material will leave the paddles until this point is reached. To ensure this mode of operation care must be taken to ensure that the pockets between the paddles are not over filled. The degree of filling of any pocket which is suitable for a material drying operation is when the cross-sectional area of the material to be dried which is loaded into a space between a paddle and a paddle preceding it in rotation of the cylinder, is less than or equal to the area enclosed by the paddle and a line from the paddle tip to the cylinder wall at the angle of repose of the material, when that paddle is at the chosen release point around the cylinder. This means that more of the paddles are brought into use at any one moment so that the area of the cylinder and paddles in contact with the material is increased to the maximum and the drop through the interior space of the cylinder is also increased to the maximum resulting in the optimum treatment. Further the point at which the material leaves the paddles is accurately controlled and is therefore consistent, resulting in consistent treatment. Until the point 21 is reached neither the angle of repose or the sliding angle is exceeded.

When the slide angle is reached with a normal radial paddle (see FIG. 2), the remaining product which has not previously tumbled off, starts to slide down the paddle with increasing acceleration as the paddle increasingly exceeds the slide angle. It can take 20° to 30° of cylinder rotation before all the product has released.

In the present invention the tobacco is held by the tip until the tip exceeds the slide angle. The main portion of the paddle is then well beyond the slide angle. The product has only to slide down a relatively short tip to be released and under the influence of the accumulated acceleration of the main portion; a sort of avalanche. Hence the tip is generally not more than one third the length of the main portion of the paddle.

The construction results in maximized utilization of the heated surface and minimized variation in the release point.

The arrangement shown in FIG. 3 may be adapted for use in a situation where mixing is required. In such an arrangement the tips are less inclined to the radius through their tip as those in FIG. 3 but in operation the pockets between them are filled to a greater extent. The degree of filling of any pocket which is suitable for a material mixing operation is when the cross-sectional area of the material loaded onto a paddle, is greater than the area enclosed by the paddle and a line from the paddle tip to the cylinder wall at the angle of repose of the material to be treated, when the paddle in question is at the chosen initial release point around the cylinder, and less than the cross-sectional area enclosed between two adjacent paddles and the wall of the cylinder. This results in the material being released from the paddles over a considerable arc indicated at 31 extending from approximately the low point of release of the prior art arrangement of FIG. 2 to the high optimized release point of the embodiments of the invention shown in FIG. 3.

With this arrangement, as the paddles progress through the arc 31, the material thereon gradually exceeds its angle of repose so that material falls off the face of the pocket of material until such time as it reached the top of the arc when the angle of sliding is reached and the remainder falls off.

Mixing is enhanced if particles of material to be treated are dropped at different points across the width and length of the cylinder. This is achieved by the spread over an arc of the release of material from the paddles; and the different drop heights across the width will result in slightly different instantaneous rates of travel down the length of the cylinder which further enhances the mixing.

In some cases, the release arc can be extended over center to a position as indicated at 32 in FIG. 3, particularly when the paddles have more inclined tips, and when the material to be mixed is of a more tacky nature to bind to itself and to the paddle.

When such a cylinder is used to treat or condition tobacco, with a liquid treatment for instance, major changes in the properties can occur. Such conditioning or treatment can embrace the application of water and/or other fluids and/or heat and steam, and thus applies to other materials than tobacco.

For example in the direct cylinder conditioning method used in the tobacco industry, the tobacco at the input could be at 10% moisture and at 25% moisture at output from the cylinder. At input the tobacco may be in compressed blocks, while at output individual pieces of tobacco can be separate and distinct leaves or lamina.

Typical properties for a tobacco type are tabulated:

| | INPUT | OUTPUT |
|---|---|---|
| Moisture | 10–14 | 18–28% |
| Density | 400 kg/m$^3$ | 40 kg/m$^3$ |

-continued

| | INPUT | OUTPUT |
|---|---|---|
| Repose Angle | 90 + | 40–60 (1) degrees |
| Terminal Velocity | — | 1–3 meters/second |
| Angle of Sliding | — | 20–35 (2) degrees |
| Angle of Repose | — | 60–80 (3) degrees |

Note:
(1) As a result of free fall from 300 mm
(2) On smooth metal plate
(3) Material on material within one body The magnitude of these changes is very significant, and in the past has required that two cylinders should be used in series. In that case the second cylinder should be larger than the first and designed for a greater volumetric throughput. (See Patent GB 8408413—W. H. Dickinson).

In a drying system discussed above, it is desirable to achieve a uniform presentation of product to the heated surfaces and to the airstream. Within a cylinder for the conditioning function, heat may be supplied via a recirculating airflow, and fluids may be applied by vaporization/micro-droplets into the airflow or by direct spray onto the product. Direct fluid spray is more commonly used than micro-droplets.

The design criteria for fluid application becomes uniform presentation of the material to the airstream and to the applied fluid droplets. The criteria of controllability and low degradation also remain important.

Figure 5:
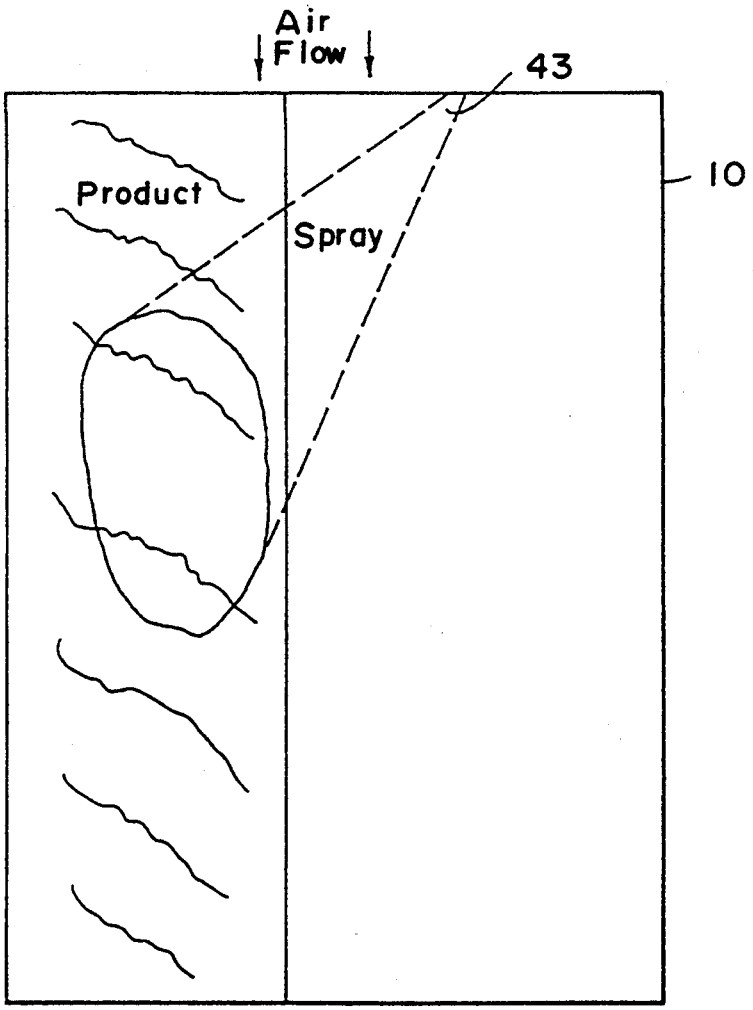
FIG. 5 shows a plan view of the cylinder of FIG. 4.

A typical fluid application arrangement with conventional paddles is shown in FIGS. 4 and 5 which show a schematic cross-section and plan view of a cylinder respectively. Product in region 42 is presented to the spray 43 and has a good opportunity to receive fluid. Lower layers of product have less opportunity with region 41 having little or no opportunity to receive fluid from the sprays.

The product is concentrated over a low arc of the cylinder 10 leaving the remainder of the circular cross section free of material and open to the airflow. Consequently pick-up by the product of heat and moisture from the air is limited and occurs predominantly at the product surface 42 and most of the airflow bypasses the product.

This conventional method is degradation prone and ineffective in achieving the process objectiveness.

In a further embodiment of the invention the internal cylinder geometry is adapted to improve the product presentation to both sprays and airstream, to remove the risk of degradation and to allow for changes in the material density/volume occurring during conditioning. This requires different geometry at different positions along the length of the cylinder in that the angle and length of the tip varies along the axial length of the cylinder. Ideally the variation is gradual or stepped.

A cylinder of this further embodiment is described with reference to FIGS. 6A, 6B, 6C and 7, which show schematic cross-sections and a plan view of a cylinder respectively.

Figure 6A:
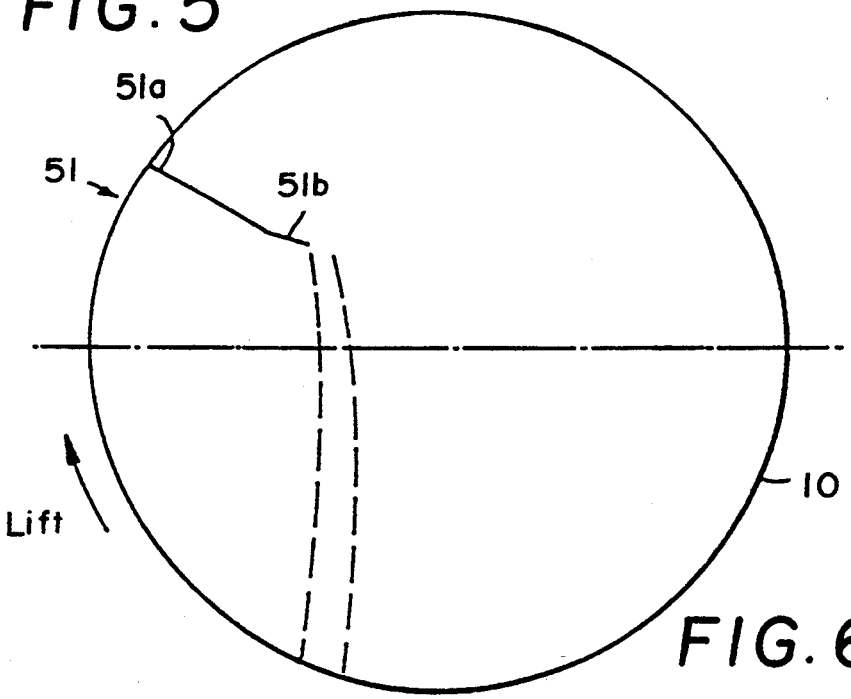
FIG. 6A is a cross-sectional view taken in the direction of line 6A—6A of FIG. 1.
Figure 6B:
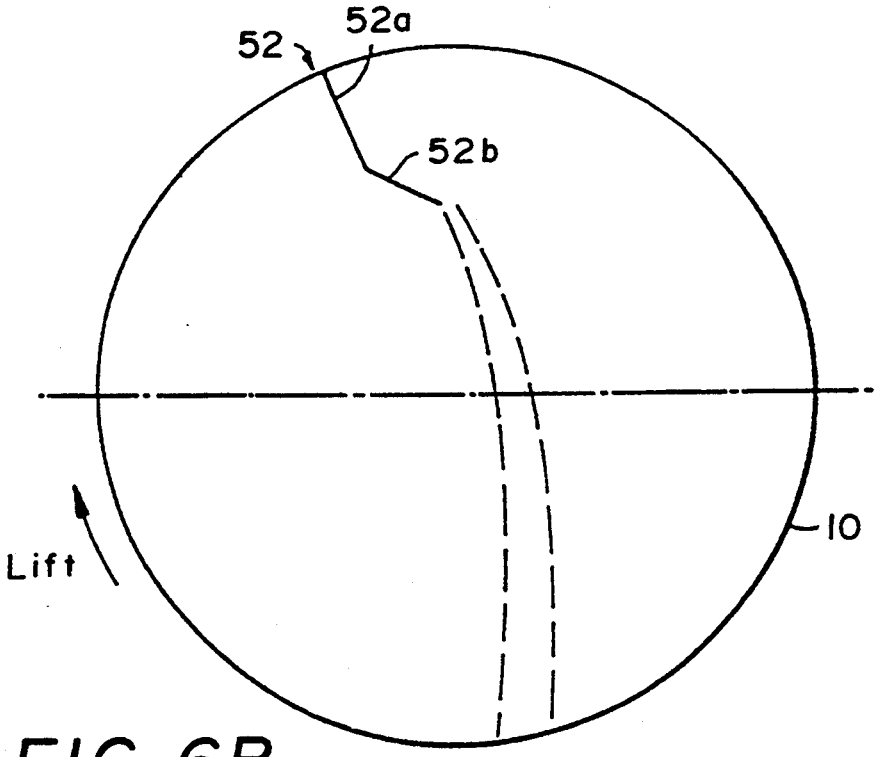
FIG. 6B is a cross-sectional view taken in the direction of line 6B—6B of FIG. 1.
Figure 6C:
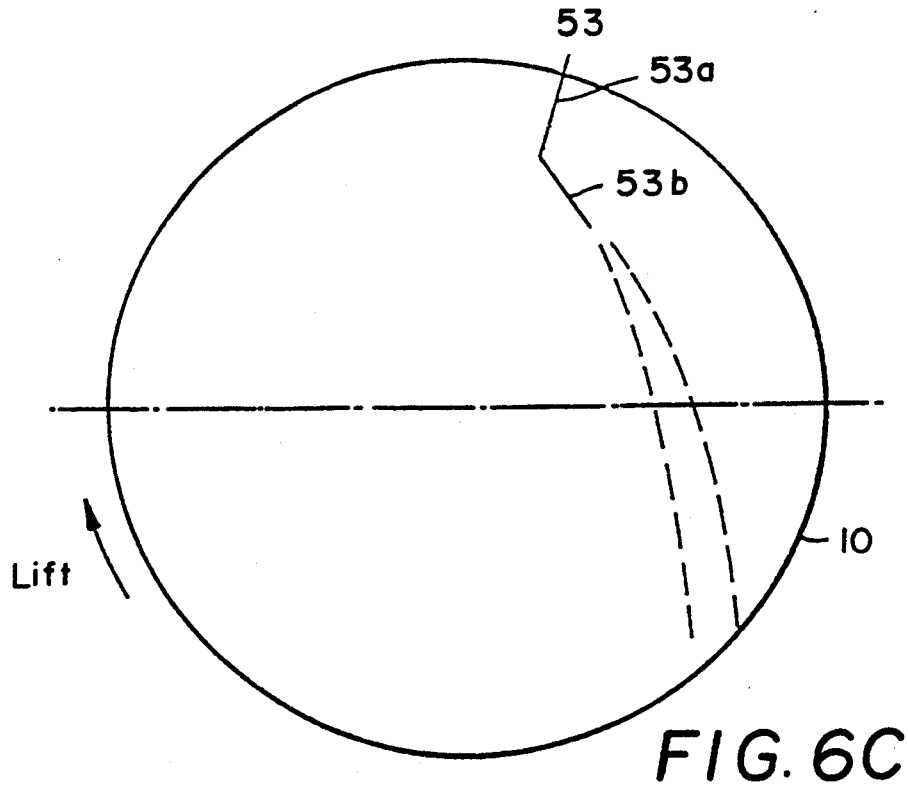
FIG. 6C is a cross-sectional view taken in the direction of line 6C—6C of FIG. 1.
Figure 7:
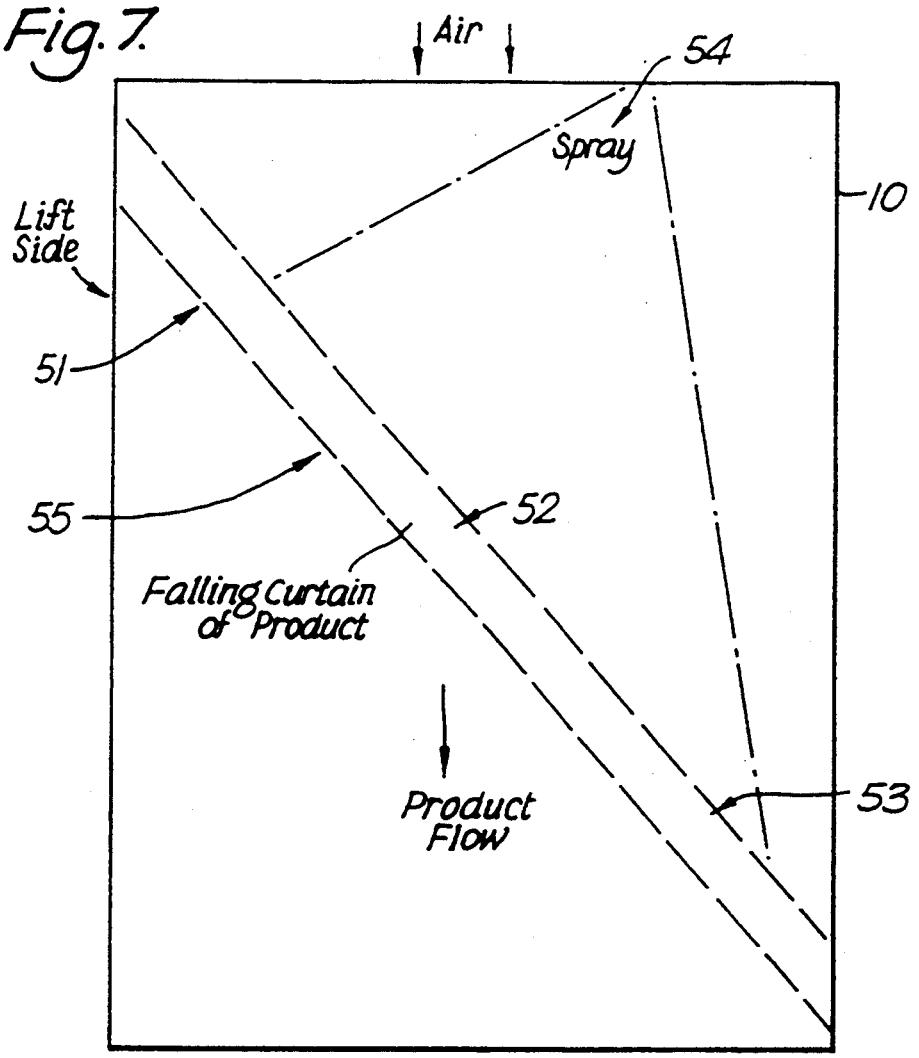
FIG. 7 shows a plan view of the cylinder of FIG. 6.

FIGS. 6A, 6B and 6C show diagrammatically the release and collection points at three axially displaced positions 51, 52 and 53, respectively along the length of the cylinder. Only a single paddle is shown at each illustrated cross-section for simplicity. Position 51 is near the start of the conditioning treatment zone from a spray 54 in the cylinder 10 while position 53 is near the end of the treatment zone. The treatment zone may be preceded by a material receiving or entry zone and followed by a material discharge zone.

In order to achieve the progression of the release point over the top arc of the cylinder, with the distance along the cylinder, each paddle is shaped at position 51 with a relatively long radial portion 51*a* and short tip 51*b* inclined to the portion 51*a*, at position 52 with a shorter radial portion 52*a* and longer inclined tip 52*b*, and at position 53 with the radial portion 53*a* just larger than the inclined tip 53*b*. The general criteria for the geometry of the paddles is similar to that discussed above for a drying operation with the exception that the release point is at a different position over the top arc of the cylinder progressively along the length of the cylinder. The criteria for filling the pockets between the paddles is again similar to that discussed above for a drying operation.

The progressive change in the release points creates the situation in FIGS. 6A, 6B, 6C and 7 and establish a falling curtain of material indicated at 55 disposed diagonally across the length of the cylinder. This increases the face area presented, on to which fluid can be sprayed and creates a situation where each material particle has a near equal opportunity to contact fluid droplets. The falling curtain also substantially covers the circular cross-section of the cylinder so that airflow along the cylinder has to pass through the curtain, so that each particle of product in the curtain has a near equal opportunity to receive heat and micro-droplets from the airstream.

The general procedure for relating product release and collection points to product properties has been discussed. In this further embodiment, the product specific volume increases during the process, and this must also be taken into account in determining the physical size and hence carrying capacity of the paddles along the length of the cylinder. Paddles at position 51 are designed to have a lower release point and to carry less volume of product than are paddles at position 53.

Figure 8:
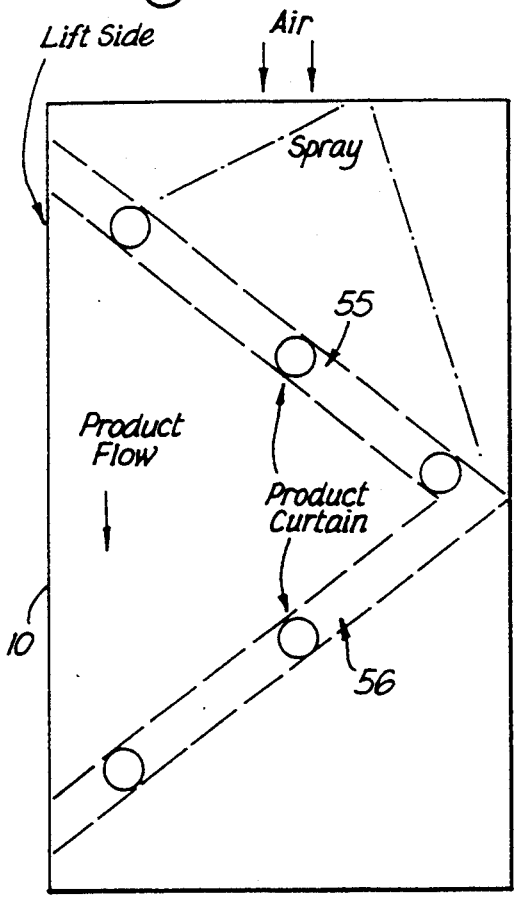
FIG. 8 shows a plan view of a further arrangement of the cylinder of FIGS. 6 and 7.

To increase the presentation of the product to the airstream further it may be desirable to create the situation shown in the schematic plan of FIG. 8 and generate a second curtain 56 following on from the curtain 55 discussed above, and a further spray (not shown) may be provided for that second curtain.

Figure 9:
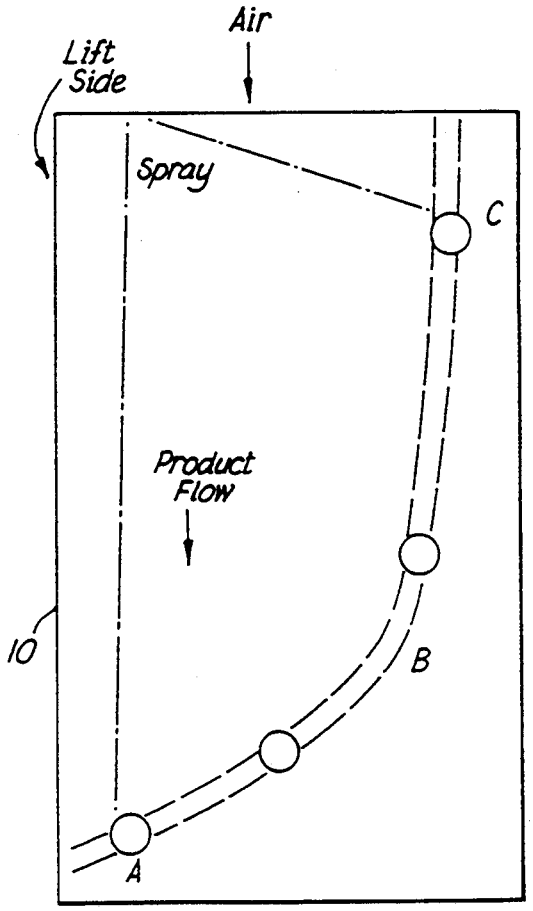
FIG. 9 shows a plan view of a yet further arrangement of the cylinder of FIGS. 6 and 7.

There are, however, instances where substantial changes in product volume do not occur during fluid application. Such an instance is the application of top flavours to tobacco in which case an alternative curtain shade as shown in the schematic plat of FIG. 9, may be applicable. This would enable a good fluid application over the portion C to B of the curtain 57, but at the same time the geometry between points A and B of the curtain could be arranged to give a mixing function.

Figure 10:
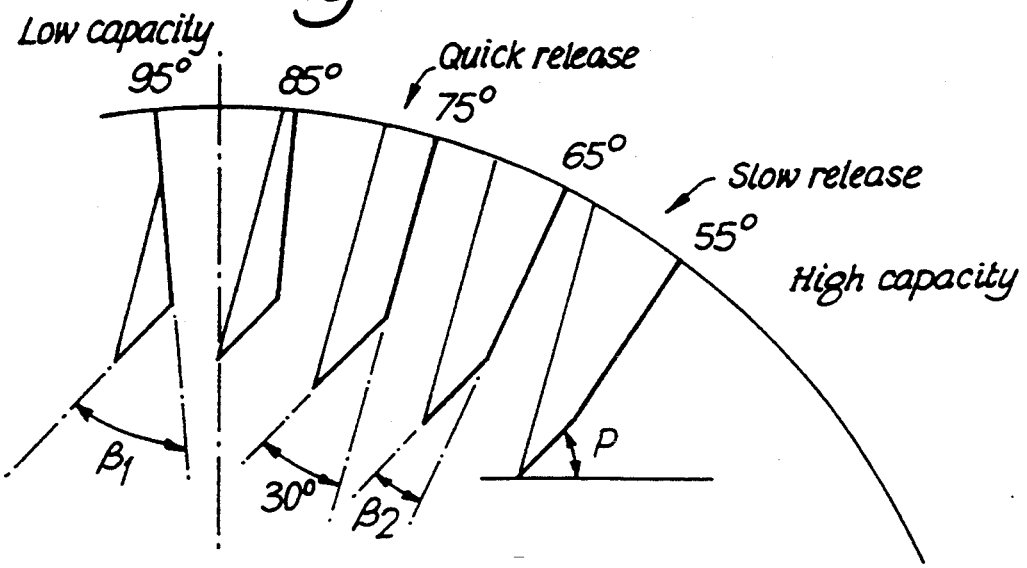
FIG. 10 is a schematic diagram showing a series of radial paddles representing a range of angles of the tip relative to the proximal portion.

FIG. 10 is a schematic diagram showing a succession of radial paddles representing a range from a paddle having a greater tip angle $\beta_1$ for lighter loads to a lesser angle $\beta_2$ for heavy loads, the slide angle and repose angles being assumed typically 45° and 75° respectively. For light loads, the tip is inclined relative to the proximal portion preferably at an angle of from about 30° up to 50°. For heavy loads, the tip angle is preferably between about 10° and 30°. Therefore, the angle formed between the tip and proximal portion is preferably between about 10° and 50°, depending on the relative weight of the load. The preferred example (P) shows the angle of repose on the equal to the angle of the main portion of the paddle.

Generally, for light paddle loads, the tip of the blades is inclined relative to the proximal portion at an angle substantially equal to the difference between the angle of repose (R) and the angle of sliding (S) and should be an angle greater than 30° up to 50°. In other instances, the tip should be inclined relative to the approximate portion at an angle substantially equal to the difference between the angle of repose (R) and the angle of sliding (S) or approximately 30°. With heavier loads, the tip should be inclined relative to the proximal portion at an angle substantially less than the difference between the angle of repose (R) and the angle of sliding (S) and should be at an angle less than 30° to approximately 10°.

I claim:

1. A rotary tobacco treatment cylinder comprising an elongate hollow cylinder arranged to rotate about its longitudinal axis, said cylinder including a cylinder wall having an inner surface and an outer surface, a plurality of elongate paddles extending from said inner surface longitudinally along the cylinder and extending generally towards said longitudinal axis, said paddles being provided to convey material to be treated from a first position within the cylinder to a predetermined release point, said paddles each having a proximal portion extending at a first angle of not more than 90° relative to a tangent to the cylinder wall at the root of said proximal portion, and a distal portion being inclined relative to said proximal portion at a second angle, said second angle being less than said first angle so as to form a tip, said tip being of a length along the length of the cylinder of less than one-half the length of said proximal portion, and wherein the geometry of the paddles and the predetermined release point varies along the length of the cylinder such that during operation of the cylinder, a curtain of falling material extends at an acute angle relative to the longitudinal axis.

2. A rotary tobacco treatment cylinder as claimed in claim 1, wherein the paddle is configured such that the cross-sectional area of the material to be treated being containable by each paddle, is no greater than an area enclosed by the paddle and a line extending from the paddle tip to said cylinder wall at an angle of repose (R) of the material, when the paddle is positioned at the predetermined release point.

3. A rotary tobacco treatment cylinder as claimed in claim 1, wherein the length of the tip of each paddle varies along the length of the cylinder.

4. A rotary tobacco treatment cylinder as claimed in claim 1, wherein said second angle varies along the length of the cylinder.

5. A rotary tobacco treatment cylinder as claimed in claim 1, wherein the tip of each paddle forms an angle (B) relative to the tangent to the cylinder wall at the root of the proximal portion of the paddle such that at the predetermined release point, said tip being at an angle of sliding (S), and the surface of the material contained by the tip being at the angle of repose (R).

6. A rotary tobacco treatment cylinder as claimed in claim 5, wherein the proximal portion of the paddle is radially disposed.

7. A rotary tobacco treatment cylinder as claimed in claim 6, characterised in that the arrangement of the paddles is as to cause the formation of a second such curtain following the first curtain axially along the cylinder.

8. A rotary tobacco treatment cylinder as claimed in claim 6, wherein said second angle is from greater than 30 degrees up to 50 degrees.

9. A rotary tobacco treatment apparatus as claimed in claim 6, wherein said tip is inclined relative to the proximal portion at an angle between about 10° and 50°.

10. A rotary tobacco treatment apparatus as claimed in claim 6, wherein said tip is inclined relative to the proximal portion at an angle of approximately 30°.

11. A rotary tobacco treatment apparatus as claimed in claim 6, wherein said tip is inclined relative to the proximal portion at an angle between 10° and 30°.

12. A rotary tobacco treatment cylinder as claimed in claim 1, wherein the cylinder is arranged substantially horizontally.

13. A rotary tobacco treatment cylinder as claimed in claim 1, wherein the cylinder is inclined relative to the horizontal such that said first position is lower than said predetermined release point.

14. A rotary tobacco treatment apparatus as claimed in claim 1, wherein said first angle is approximately 90°.

15. A rotary tobacco treatment cylinder as claimed in claim 1, further comprising means for applying heat to the cylinder.

16. A rotary tobacco treatment cylinder as claimed in claim 1, further comprising means for applying heat to the paddles.

17. A rotary tobacco treatment cylinder as claimed in claim 4, further comprising means for delivering fluid to the cylinder.

18. A rotary tobacco treatment apparatus as claimed in claim 1, wherein said tip is inclined relative to the proximal portion at an angle between about 10° and 50°.

* * * * *